US007188836B2

(12) United States Patent
Yamamiya

(10) Patent No.: US 7,188,836 B2
(45) Date of Patent: Mar. 13, 2007

(54) COMPACT DRIVING UNIT FOR AN AUTOMATIC BANKNOTE RECEIVING AND STORING DEVICE

(75) Inventor: Takahito Yamamiya, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 320 days.

(21) Appl. No.: 10/657,376

(22) Filed: Sep. 8, 2003

(65) Prior Publication Data

US 2004/0119225 A1 Jun. 24, 2004

(30) Foreign Application Priority Data

Sep. 9, 2002 (JP) ..... 2002-263313

(51) Int. Cl.
*B65H 29/38* (2006.01)

(52) U.S. Cl. ..... 271/177; 271/180

(58) Field of Classification Search ..... 271/177, 271/180, 181; 109/45, 47; 194/206, 207; 209/534

See application file for complete search history.

(56) References Cited

U.S. PATENT DOCUMENTS 5,372,361 A * 12/1994 Isobe et al. ..... 271/181
5,411,249 A * 5/1995 Zouzoulas ..... 271/181
5,676,366 A * 10/1997 Polidoro ..... 271/176
5,730,271 A * 3/1998 Buchman et al. ..... 194/206
6,659,452 B2 * 12/2003 Abe et al. ..... 271/181
6,712,352 B2 * 3/2004 Bergeron et al. ..... 271/180
6,948,607 B2 * 9/2005 Ito et al. ..... 194/206
2002/0060405 A1 * 5/2002 Iwai et al.
2002/0175463 A1 * 11/2002 Abe et al. ..... 271/177
2003/0137095 A1 * 7/2003 Ito et al. ..... 271/176

FOREIGN PATENT DOCUMENTS

JP 2003-123121 * 4/2003

* cited by examiner

*Primary Examiner*—Patrick Mackey
*Assistant Examiner*—Thomas Morrison

(57) ABSTRACT

A compact driving unit for an automatic banknote receiving and storing unit. The banknote receiving and storing unit includes a banknote accepting unit, a safe unit, a transporting unit for moving an accepted banknote to a position adjacent the safe unit, a translating unit for non-rotationally displacing the accepted banknote into the storing section of the safe unit, and a driving lever pivoted by a driving crank in the transporting unit to operate the translating unit. The safe unit and the transporting unit are removable from a chassis.

9 Claims, 7 Drawing Sheets

COMPACT DRIVING UNIT FOR AN AUTOMATIC BANKNOTE RECEIVING AND STORING DEVICE

CROSS-REFERENCE TO RELATED APPLICATION

This application is based on an application number 2002-263313 filed in Japan, dated Sep. 9, 2002.

FIELD OF THE INVENTION

The present invention is related to a banknote handling device and more particularly to a compact driving unit for an automatic banknote receiving and storing device for use in a vending machine or banknote changer where a banknote can be translated by a non-rotational displacement into a storing section by a translating unit that occupies a relatively small space.

DESCRIPTION OF RELATED ART

Previously, small, automatic banknote receiving and storing units are known for use in a vending machine or a banknote changer where a received banknote is pushed into a safe unit by a pushing unit, and the banknote is stored. The pushing unit includes a pushing board and a moving unit such that the pushing board moves while keeping the banknote parallel to the storage orientation.

Such a moving unit is disclosed in the Japanese Patent Document 2922441 which corresponds to U.S. Pat. No. 5,836,435 granted to Fujita, et al. In the Fujita et al. reference, a pair of crossed links pivot on a supporting point located at a crossing point, and the links reciprocate in a scissors like motion to drive a pushing board when a motor operates an attached crank located adjacent to the crossed links. As a result, the pushing board can reciprocate to push a banknote into a storing section.

Another type of transporting unit is disclosed in the Japanese Laid Open Patent Application 8-202923 which corresponds to U.S. Pat. No. 5,411,249 granted to Zouzoulas. In this reference, a rotating crank causes a linkage to pivot at a middle point to move a pushing plate. The pushing plate moves a banknote into the storing section while maintaining an orientation parallel to the storing orientation.

Generally, a crank can be located parallel to the linkage which prevents the linkage from being made smaller, since the linkage must be at least of the same diameter as the crank. Also, if the linkage pivots in series towards the direction of the storing section, an adequate area for the movement must be maintained, and a larger space is required. If the size of the receiving and storing device is limited, the storing quantity will be undesirably reduced.

Accordingly, there is still a demand in the prior art to provide a unique compact design to conserve space while maintaining a larger storing capacity.

SUMMARY OF THE INVENTION

The present invention addresses the limitations of the prior art by providing a compact banknote receiving and storing device that includes a novel transporting linkage operated by a driving lever.

The compact driving unit for an automatic banknote receiving and storing unit includes a box like chassis including a storing section, a banknote accepting unit, a safe unit including a translating unit and a banknote storing section, a driving lever, and a transporting unit for the accepted banknotes. A banknote is received by the banknote accepting unit and determined if it is genuine. If the received banknote is determined to be genuine, it is passed to the transporting unit which moves the banknote to a position adjacent to the storing unit. From this position, a translating unit non-rotationally displaces the accepted banknote into the storing section of the safe unit. The translating unit includes a pushing board and a parallel linkage.

The driving lever pivots in a plane which is parallel to the side of the safe unit, which is parallel to the plane traversed by the transporting unit and safe unit as it is attached to or removed from the chassis. As the transporting unit and safe unit are inserted into the chassis, the driver on the driving crank engages with a driven end of the driving lever while a driven pin on the safe unit engages with the driving end of the driving lever.

The driven pin on the safe unit is mounted on a first driven lever and receives a driving force from the driving lever. The first driven lever is linked with a second driven lever by an elastic member that applies a variable contraction force so that when the first driven lever receives a driving force, the second driven lever receives a driving force through the elastic member. The second driven lever operates the translating unit to non-rotationally displace a banknote into the safe unit storing section.

The amount of force applied by the translating unit is varied and limited by the elastic member to accommodate a difference in the translating force applied based on the variable quantity of banknotes stored in the storing section. If the storing section is nearly full of banknotes, the force resisting the translating of additional banknotes into the storing section can be larger than when the storing section is mostly empty. Hence, the elastic member limits the amount of force applied to a translated banknote thereby reducing the possibility that the banknote may be damaged in the translating and storing process.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
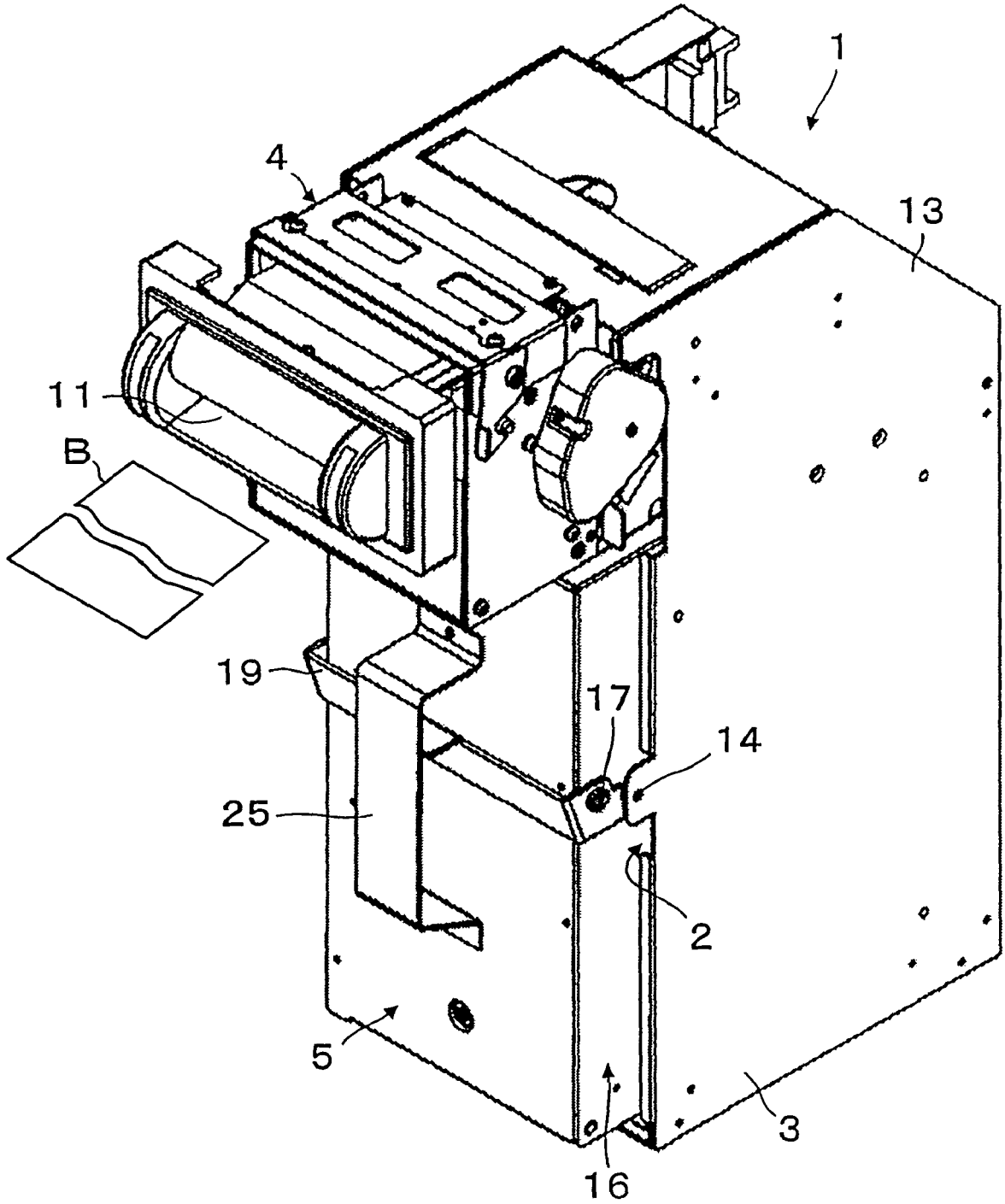
FIG. 1 shows a perspective view of a compact driving unit for an automatic banknote receiving and storing device of an embodiment of the present invention.

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the intention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

In reference to FIGS. 1–4, the compact driving unit for an automatic banknote receiving and storing device 1, also called a banknote receiving and storing unit 1, includes a box like chassis 3 including a storing section 2, a banknote accepting unit 4, a safe unit 5 including a translating unit 48 and a storing section 54, a driving lever 6, and a transporting unit 9 for the accepted banknotes. The transporting unit 9 includes a first transporting unit 7 and a second transporting unit 8 for receiving accepted banknotes (verified authentic banknotes) from the banknote acceptor 4 and moving the accepted banknotes through the first transporting unit 7 and the second transporting unit 8 which are located in series with the banknote acceptor 4 to transport a received banknote B through the transporting unit when the received banknote B has been verified.

Various mechanisms and sensors are known for determining whether a banknote is genuine or counterfeit, and accordingly are not included herein. In this specification, a banknote is a generic name which may include a note, folding money, a script, a check, a security bond, a coupon, a ticket, or other similar article which may be accepted and transported as indicated herein. The transporting unit 9 is trapezoidal in shape and is located in the upper storing section 2A which is separated from the lower storing section 2B by the separating board 10. The transporting unit 9 can slide on the separating board 10. The transporting unit 9 is locked at a predetermined position to the body 3 by a locking unit (not shown).

The second transporting unit 8 may preferably include a pair of belts (phantom lines in FIG. 2) which grip and transport the banknote B. The belts are driven by the first transporting unit 7, but it is possible to change to another type of transport mechanism with a similar function of transporting a banknote from the banknote acceptor 4 to the safe unit 5.

Banknote B is received at the banknote receiving slot 11 and is examined by the banknote acceptor prior to being passed to the first transporting unit 7. Examined, as used herein, refers to a distinguishing function where a banknote is determined to be either genuine or counterfeit. When the banknote B is determined to be genuine, the banknote is transported to the safe unit 5 by the second transporting unit 8, after which the transported banknote is stored in the banknote storing section 54.

In reference to FIGS. 3–7, the structure and functions of the safe unit 5 are explained. The safe unit 5 is a box like chassis and can be removed from the lower storing section 2B. The safe unit 5 is located below the banknote transporting unit 9 and is held by a locking unit 12. The locking unit 12 includes a pin 14 which is fixed at the right side cover 13, a pin 15 which is fixed at the left side cover (not shown) and a locking lever 19 which is channel like in shape and pivots on shafts 17 and 18 which protrude from both sides of the outer cover 16 of the safe unit 5.

Figure 2:
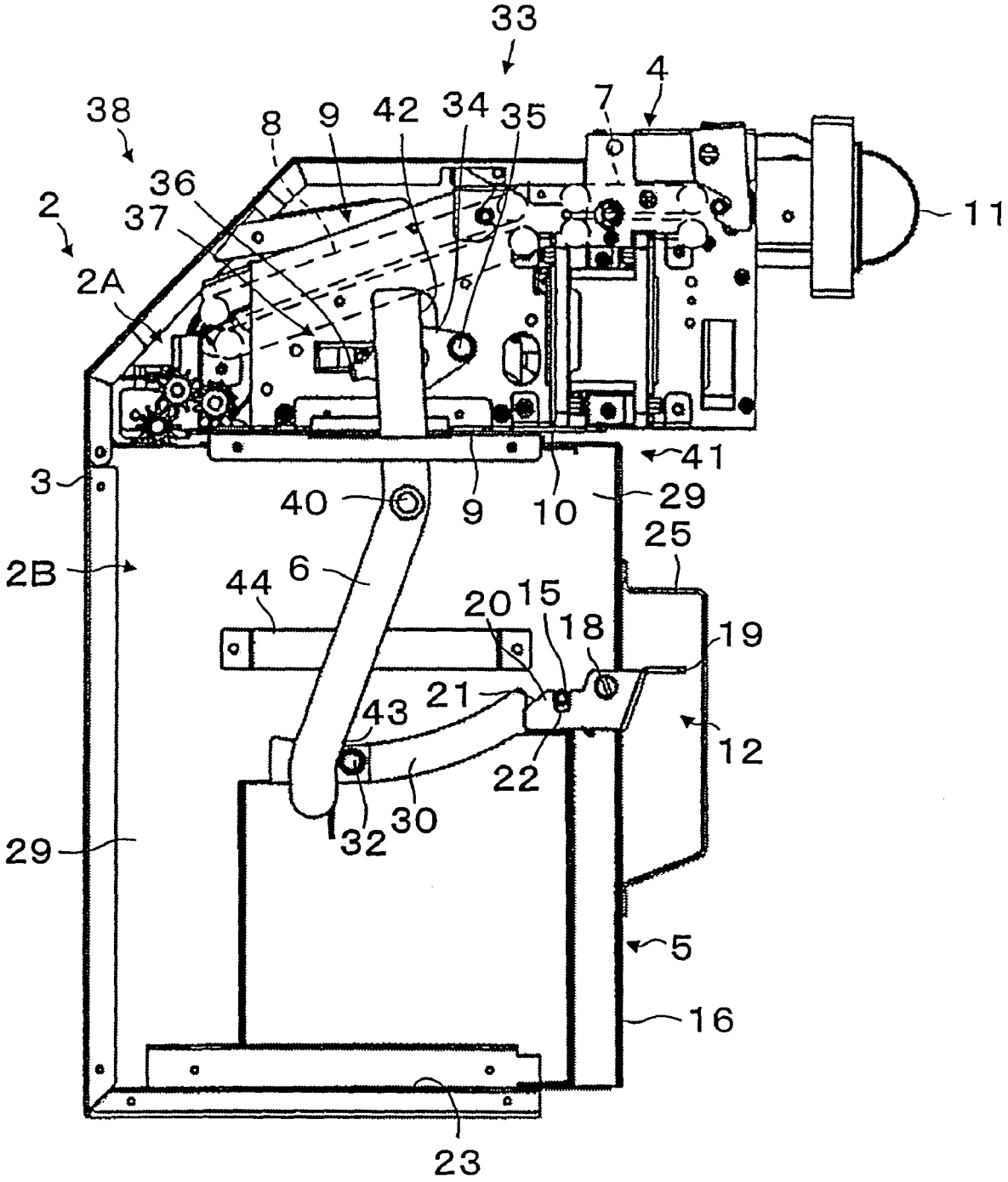
FIG. 2 is a left side view of the compact driving unit for an automatic banknote receiving storing device with a left side cover removed.

The slanting guiding section 21 and U-grooves 22 are located at the hook section 20 which is located beside the outer cover 16. The locking lever 19 pivots in the clockwise direction as shown in FIG. 2 by a spring (not shown) and is stopped by the outer cover 16. When the safe unit 5 slides on the guiding rail 23 and is located at a predetermined position within a lower storing section 28, the U grooves 22 have contact with pins 14 and 15 and the safe unit is kept at a predetermined position.

Figure 3:
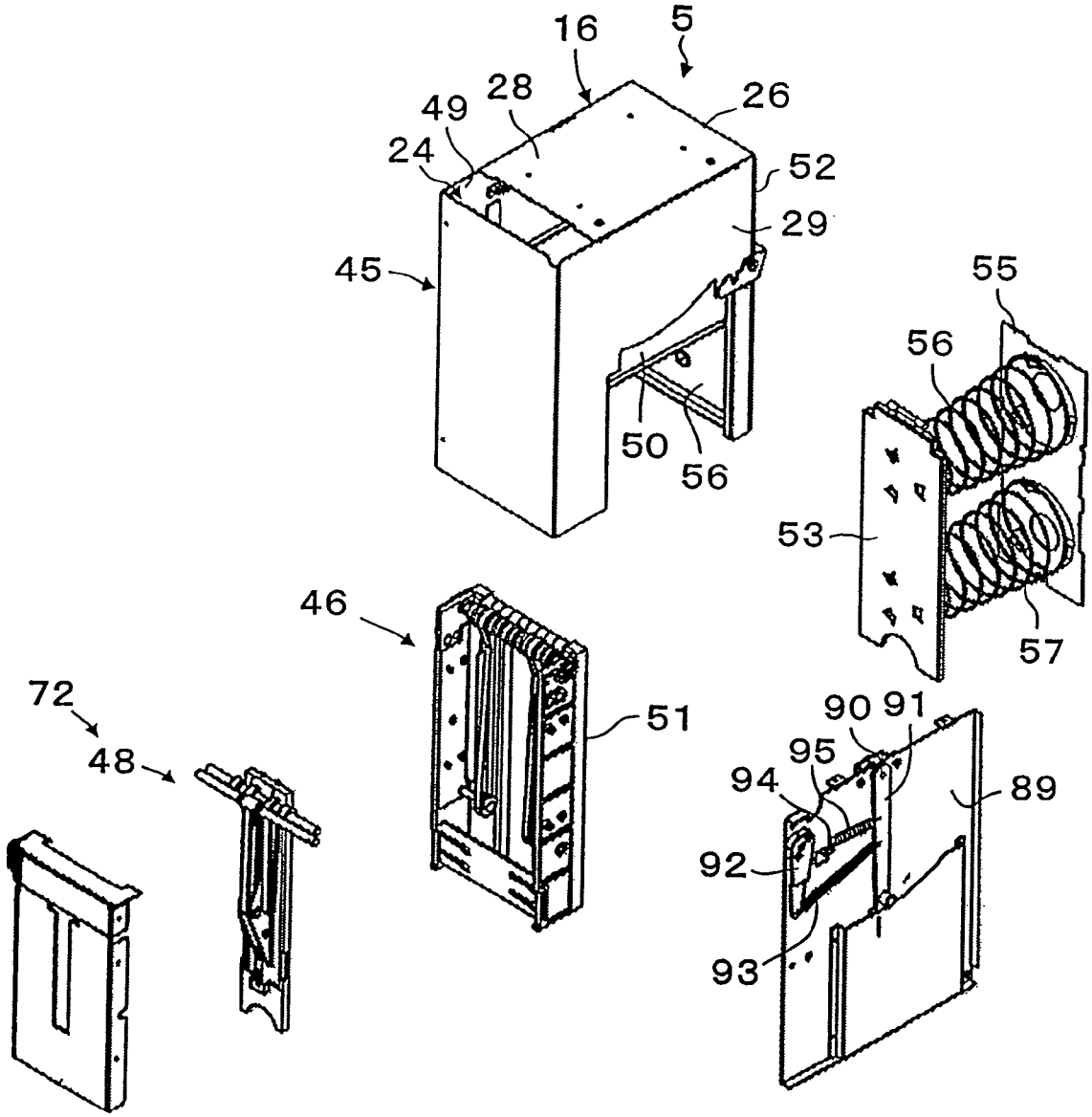
FIG. 3 is an exploded perspective view of the safe unit.
Figure 4:
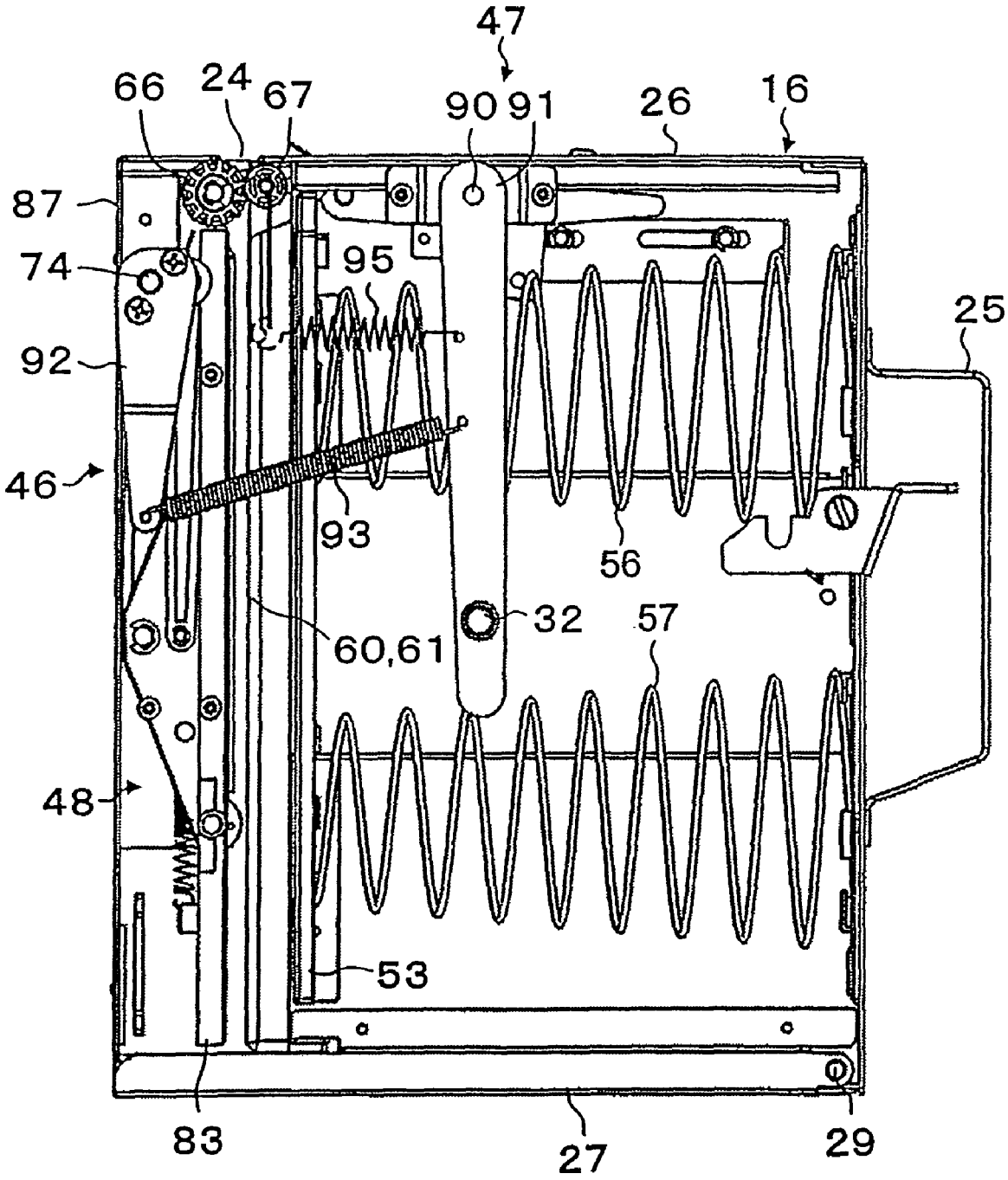
FIG. 4 is a cross sectional view of the safe in a standby situation when not actively translating a banknote in the storing section.

In reference to FIGS. 3–4, the safe unit 5 receiving slot 24 is aligned with an exit point of the transporting unit 9. The handle 25 is channel like in shape and is fixed at safe unit 5 of the side of the banknote acceptor 4. The safe unit 5 can be detached and attached at chassis 3 by gripping the handle 25, operating the locking unit, and moving the safe unit 5. For example, the banknote receiving and storing unit 1 may be built as a part of a vending machine.

The outer cover 16 of safe unit 5 includes a box like outer case 26 which opens at the bottom using banknote access door 27 as shown in FIG. 4. The banknote access door 27 can pivot on pin 29. The banknote access door 27 is opened to remove accumulated banknotes in the banknote storing section 54. The pin 29 is fixed at the bottom right corner of the outer case 26 as shown in FIG. 4.

The banknote access door 27 is locked at the outer case 26 by a locking unit (not shown). The receiving slot 24 is oriented vertically in FIG. 4 and receives the accepted banknote B from the second transporting unit 8. The opening for the receiving slot 24 is on the upper surface of the safe unit 5 located at the upper wall 28 of the outer case 26. An elongated hole 30 in the shape of an arc is located at the left wall 29 of the outer case 26. A driven pin 32 protrudes into the outside of the left wall 29 from the elongated hole 30.

In reference to FIG. 2, crank 34 is a disk and is fixed on the output shaft of the motor with a reducer (not shown) and is located at the left side wall of the transporting unit 9. The driver 35 is a rotateable element and is attached at an eccentric position of crank 34. Driver 35 can be a rolling element such as a roller bearing or a fixed pin. The operating plate 36 is a hook like protrusion and is formed at the opposite side of the crank 34 from driver 35. The sensor 37 faces the rotating excursion of operating plate 36 and is fixed at transporting unit 9. The operating plate 36 and the sensor 37 comprise a one rotation detecting unit 38. When sensor 37 detects the presence of the operating plate 36, the motor stops, and the crank 34 stops at a predetermined phase.

In reference to FIG. 2, the driving lever 6 is attached to pivot near a midpoint on the fixed shaft 40. The fixed shaft 40 is in turn fixed at the inside of the left side cover (not shown) of lower storing section 28 of chassis 3. The driving lever 6 is bent or boomerang like in shape with an angle formed at the pivot point. The driving lever 6 can pivot in a plane that it is parallel to the edge surfaces of the transporting unit 9 and the safe unit 5 located respectively above and below the driving lever 6. The driving lever 6 can also be a straight member to accommodate a different location of the driving crank 34 and driver 35.

The driving lever 6 has a driven section 42 and a driving section 43. The driven section 42 is a straight end section at the upper section of driving lever 6 at the side of attaching opening 41 of storing section 2 as shown in FIG. 2. The driven section 42 has contact with the driver 35 as it traces an orbital motion. The driving section 43 is the lower bended section which is located at the lower section of driving lever 6 below the side of the attaching opening 41. The driving section 43 has contact with the driven pin 32.

The driving lever 6 is guided to pivot along the left side cover by guide 44 which is fixed at the inner surface of the left side cover. The driving lever 6 reciprocates once for every rotation of the driving crank unit 33. The driven pin 32 is pivoted in the counter clockwise direction by driving section 43 of driving lever 6 as shown in FIG. 2, and afterwards can be pivoted in the clockwise direction by a return spring 95.

Next, in reference to FIGS. 3–7, the structure inside the outer cover 16 of the safe unit 5 is explained. The banknote storing box 45, storing transporting unit 46, storing driving unit 47 and translating unit 48 are enclosed within the inside outer cover 16. The banknote storing box 45 is composed of a right wall 49, a middle left wall 50 which is fixed at the inside of left wall 29 of outer cover 16, an upper wall 28, a reverse surface 51 of the banknote guides 60 and 61, a rear wall 52, and a banknote access door 27.

Figure 5:
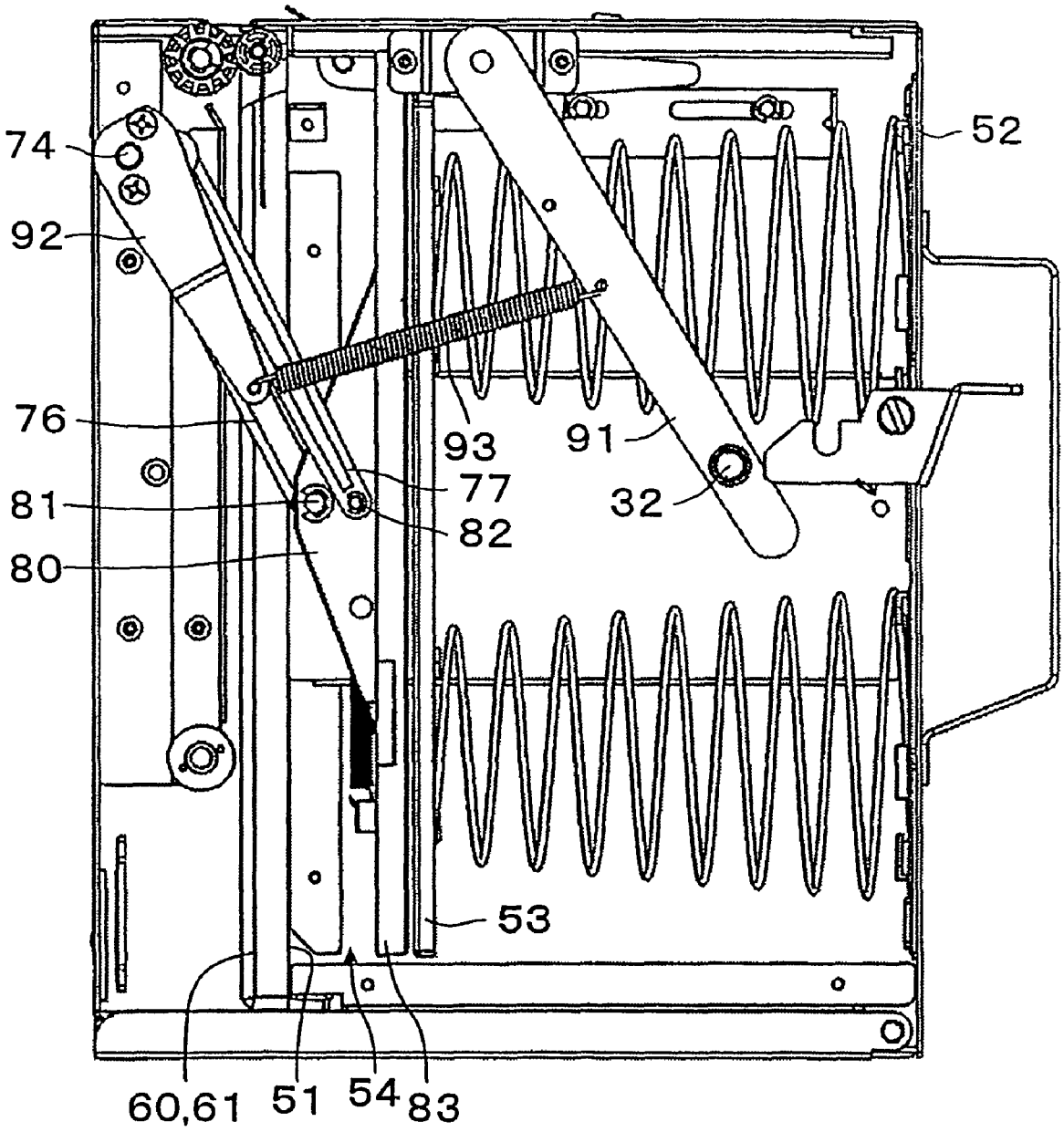
FIG. 5 is a cross section view of the safe when it translates a banknote into the storing section.

The banknote storing section 54 is enclosed by a right wall 49, a middle left wall 50, an upper wall 28, a reverse surface 51, a rear wall 52, a banknote access door 27, and a holding board 53. The holding board 53 is attached at the end of a pair of spring 56 and 57, the other end of which are fixed at the base 55. Base 55 is fixed at the rear wall 52 of the banknote storing box 45. The holding board 53 is urged toward the banknote guides 60 and 61 by springs 56 and 57 and can move in a left and right direction in note storing section 54 as shown in FIGS. 4–5.

Figure 6:
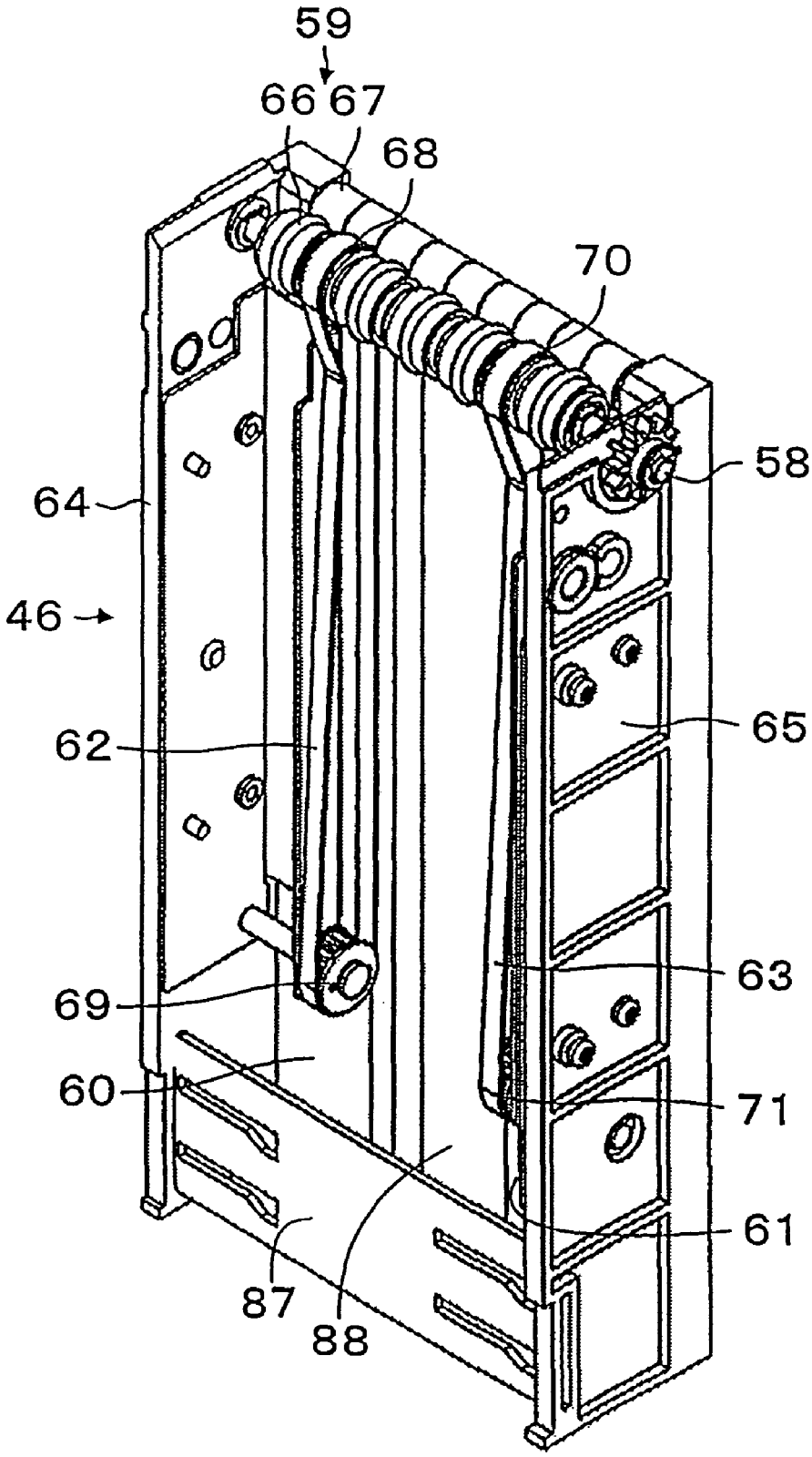
FIG. 6 is an enlarged perspective view of the banknote transporting unit of the safe of the embodiment.

In reference to FIG. 6, the storing transporting unit 46 includes the shaft 58, the sending roller unit 59, a pair of note guides (60, 61), belt 62 which is located along note guide 60, and belt 63 which is located along note guide 61 as shown in FIG. 6. The pair of note guides (60, 61) are located below the sending roller 59 and are away from each other at a predetermined distance.

The sending roller unit 59 includes the sending roller 66 which is fixed at shaft 58 which can rotate as fixed at a pair of side walls 64 and 65 located outside the banknote guides 60 and 61 and idling roller 67 which has contact with the sending roller 66. The shaft 58 is rotated by the driving motor of first transporting unit 7 through the second transporting unit 8 as shown in FIGS. 2 and 6.

The banknote guide 60 is a flat plate that is fixed at the side wall 64 and which extends perpendicularly under the idling roller 67. Banknote guide 61 is similar to banknote guide 60. The belt 62 is drawn between the timing pulley 68 which is fixed at shaft 58 and the idling pulley 69. Belt 63 is similarly drawn between the timing pulley 70 and the idling pulley 71. The contact pressure between belt 62 and the banknote guide 60, and the contact pressure between belt 63 and the banknote guide 61, can draw in a banknote B into the receiving slot 24. While belts are preferably used, the storing transporting unit 46 can use rollers instead to provide the function of transporting and releasing the banknote B.

Figure 7:
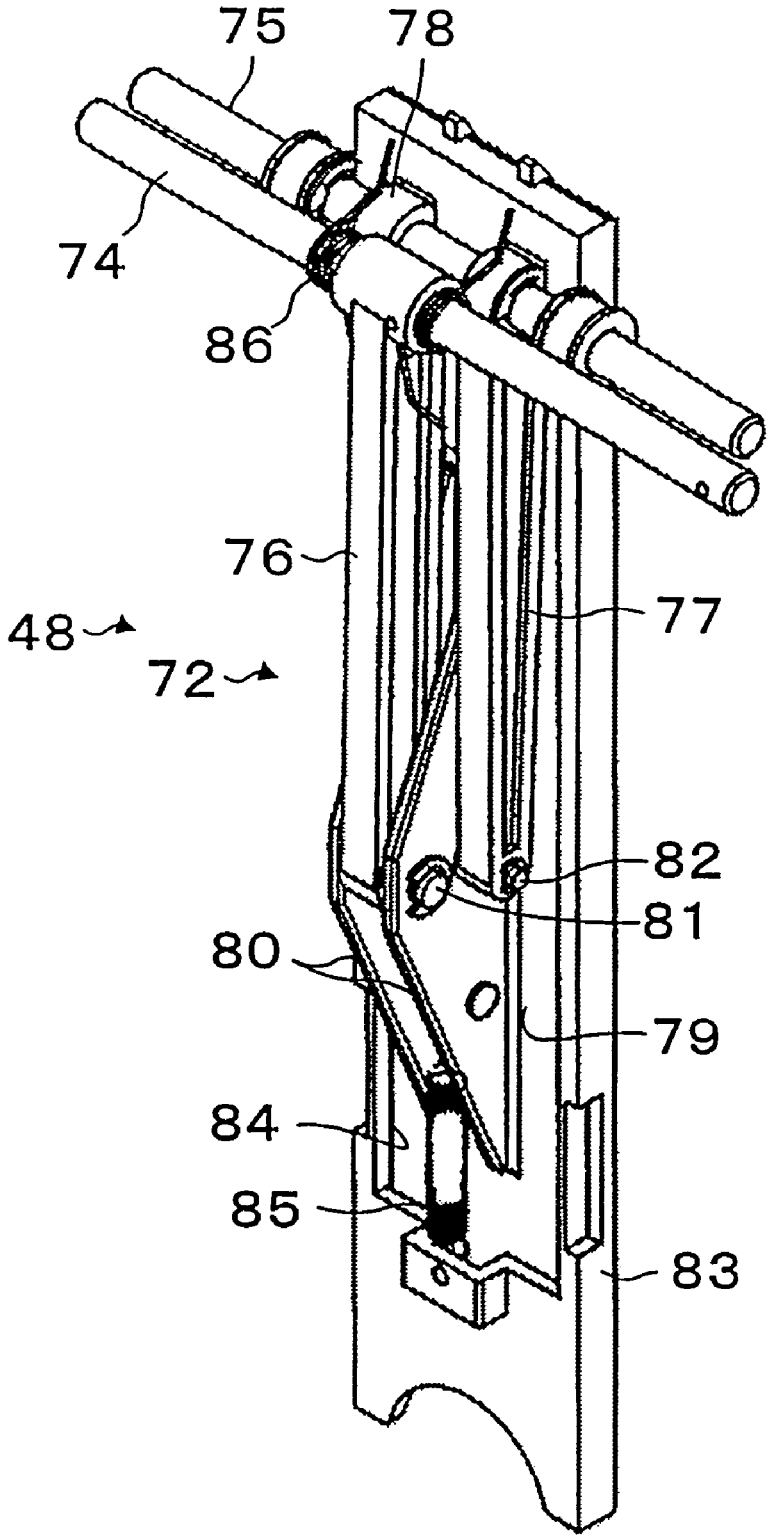
FIG. 7 is an enlarged perspective view of a translating unit.

In reference to FIG. 7, the translating unit 48 has a function which moves the received note in a non-rotational displacement from a position in the receiving slot 24 into the banknote storing section 54. The translating unit 48 uses a pushing unit 72 to move the received banknote into the storing section 54. A pair of shafts (74, 75) are arranged in a parallel fashion and are separated from each other a predetermined distance as fixed in the side walls (64, 65) adjacent to the sending roller unit 59. The upper end of the first link 76 is radially attached and fixed at the shaft 74. The second link 77 and third link 78 are similarly radially attached and fixed at the shaft 75 and are located on either side of the first link 76. The links (76, 77, 78), also called link members, have the same length L and are driven from the same end as shown in FIG. 7.

The lower end of each link (76, 77, 78) is attached at a pair of triangle brackets 80 which protrude from the sliding board 79 by pin 81, and can pivot on pin 81. The lower end of the second link 77 and the third link 78 can pivot at the base of the triangle bracket 80 by pin 82 so that the bracket is translated in a non-rotational displacement. The shafts (74, 75) and the links (76, 77, 78) and the brackets 80 comprise a parallel linkage as shown in FIG. 7.

The parallel linkage preferably has three link members and two triangular brackets, but can be embodied with two link members (76, 77) and only one bracket 80. The parallel linkage of the preferred embodiment has the advantage that a larger non-rotational displacement can be realized if the link members are not mounted on the same face of a single bracket 80. The staggered positioning of the link members (76, 77, 78) allows for a larger non-rotational displacement of the bracket 80 and the attached pushing board 83.

The sliding board 79 is a plate like structure inserted into a hollow portion 84 of a pushing board 83 so that the sliding board may move up and down a predetermined distance within the pushing board 83 as shown in FIG. 7 as the pushing board 83 is translated in a non-rotational displacement as shown in FIG. 5.

The spring 85 is attached between the pushing board 83 and the triangle bracket 80 so that the pushing board 83 is urged upwards by the spring 85. The side walls (64, 65) are fixed at plate 87 to form a unit as shown in FIG. 6. The translating unit 48 integrates the storing transporting unit 46 and the pushing unit 72 and is attached to the outer case 26. In a standby condition, the first link 76 is urged in a clockwise direction by spring 86 (as shown in FIG. 7) so that the pushing board 83 is located in the position (as shown in FIG. 4).

In the standby condition, the pushing board 83 is located at the left-most position away from the banknote storing section 54, and to the left of the banknote-guides 60 and 61 as shown in FIG. 4. The banknote guides (60, 61) are separated by a predetermined distance to form an opening 88. The opening 88 permits the passage of the pushing board 83 through the opening to push a banknote B from a position in the receiving slot 24 into the banknote storing section 54. A high friction member (not shown) can be attached at the contacting surface of pushing board 83, to further reduce the slip between note B and the contacting surface of the pushing board 83. The high friction member can be, for example, a rubber sheet.

In reference to FIG. 4, the storing driving unit 47 is now explained. The storing driving unit 47 drives the translating unit 48 (pushing unit 72). The separating wall 89 is fixed inside the outer case 26 at a predetermined distance away from the left wall 29. The first driven lever 91 extends downwards and pivots at a fixed shaft 90 which is located at the upper section of the separating wall 89. The driven pin 32 is fixed at the lower side wall of the driven lever 91. The driven pin 32 can be changed to a roller bearing, a roller element, or a fixed pin such as the driver 35.

The second driven lever 92 extends downwards and is fixed at shaft 74 of the pushing unit 72. The spring 93 is attached between the first driven lever 91 and the second driven lever 92. The spring 93 is an elastic member for applying a variable contraction force along an axis defined by its end points. The contraction force depends on the displacement between the end points where a larger contraction force is caused by a larger displacement, while a smaller contraction force is caused by a smaller displacement. The spring 93 may be replaced with a rubber band or other such member with a similar resilient function. Spring 95 is attached between the first driven lever 91 and a projection 94 which is fixed at the separating wall 89. Similarly, in this specification, the spring 95 may also be replaced by an elastic member.

When the first driven lever 91 is pivoted in the counter-clockwise direction by the driving lever 6 through driven pin 32 (as shown in FIG. 4), the spring 93, the second driven lever 92, and the shaft 74 are pivoted in the same direction, and the pushing board 83 is moved into the storing section 54 by the parallel linkage. At the same time, the sliding board 79 moves upwards by the parallel linkage, however it slides along the pushing board 83 to reduce any slip with the received banknote B as it is moved in a parallel fashion. When the driving lever 6 is not pushing driven pin 32, spring 95 can pull the first driven lever 91 in a clockwise direction. The first driven lever 91 stops at a predetermined position by making contact with a bumper or stopper (not shown).

In reference to FIG. 1, the operation of the banknote receiving and storing unit 1 is explained. Initially, there are no banknotes stored in the storing section 54 and the safe unit 5 is considered empty. A user grips the handle 25 of the safe unit 5 and inserts the safe unit 5 by sliding into the lower storing section 2B of the chassis 3. As the safe unit 5 is inserted into the lower storing section 2B, the pins (14, 15) make contact with their corresponding U-grooves 22. The U-grooves 22 engage their corresponding pins (14, 15) and the safe unit 5 becomes locked in the lower storing section 2B of the chassis 3.

In this position, receiving slot 24 is aligned with the outlet in the upper storing section 2A of the transporting unit 9. Accordingly, the outlet of transporting unit 9 is aligned with the sending roller unit 59 of safe unit 5. At the same time, the driven pin 32 is located near driving section 43 of driving lever 6 so that the driven pin 32 is engaged in the pivoting plane of driving lever 6.

Similarly, when the transporting unit 9 is attached in the upper storing section 2A, the rear section of the transporting unit 9 is inserted into the attaching opening 41, and the transporting unit 9 is slid into position. At the same time, driver 35 of the driving crank 33 moves towards driven section 42 of driving lever 6, and it stops at a predetermined position by a bumper (not shown), and transporting unit 9 is locked. In this condition, driver 35 can move in a reciprocating fashion in the pivoting plane of driving lever 6 to alternately make and break contact with driving lever 6, thus pushing the driving lever 6.

In reference to FIGS. 2 and 4, the standby condition is explained. Driver 35 is located on the banknote acceptor 4 side of the driving lever 6. Accordingly, the driving lever 6 pivots in the counter clockwise direction driving section 43 and has contact with driven pin 32. In the safe unit 5, the first driven lever 91 is pivoted in the clockwise direction by spring 95, and the first link 76 is pivoted in the clockwise direction by spring 86 so that the pushing board 83 moves towards the left. The top of the triangle bracket 80 has contact with the plate 87. At the same time, the pushing board 83 is located at the opposite the banknote storing section 54 and is pulled upwards by the spring 85 so that the pushing board 83 is located in the uppermost position.

Next, in reference to FIGS. 1 and 5, the storing operation is explained. When a banknote B is inserted into the banknote receiving slot 11, it is detected by a sensor (not shown) starting the operation of the first transporting unit 7 and the second transporting unit 8, and the banknote acceptor 4 examines the inserted banknote B. The banknote acceptor 4 examines the banknote B while transporting the banknote into the banknote acceptor unit 4 by the first transporting unit 7.

If the banknote acceptor 4 determines the inserted banknote B is a counterfeit, the first transporting unit 7 rotates in the counter clockwise direction, and the banknote B is returned to the banknote receiving slot 11. When banknote acceptor 4 detects the received banknote B is genuine, the banknote B is moved from the first transporting unit 7 to transporting unit 8 within the transporting unit 9. The received banknote B is ultimately passed from the transporting unit 9 into the receiving slot 24.

As shown in FIGS. 4 and 6, the received banknote B is passed into the receiving slot 24 by being pulled between the sending roller 66 and the idling roller 67. The received banknote B is pulled downwards and pressed in between the banknote guides (60, 61) and the drive belts (62, 63). When the trailing edge of the received banknote B (the upper end as shown in FIG. 4) passes through the sending roller unit 59, the sending roller unit 59 stops the rotation so that the received banknote B is held between the banknote guides (60, 61) and the drive belts (62, 63) in a position parallel to the opening 88.

When the received banknote B is in this position, a motor with a reducing gear assembly (not shown) is activated and crank 34 rotates in the counter clockwise direction one full rotation. When the operating plate 36 is detected again in the standby position, the motor stops. When the motor is active, the driver 35 reciprocates in an orbital motion to push the driven section 42 of the driving lever 6 so that the driving section 43 pushes the driven pin 32 as the driving lever 6 pivots in a counter clockwise direction as shown in FIG. 2. The transporting unit may be operated by one or more motors.

Further, when the driving lever 6 pivots in the counter clockwise direction, the driving section 43 pushes the driven pin 32 to the right as shown in FIG. 5. In this case, the first driven lever 91 pivots in the counter clockwise direction and the second driven lever 92 follows by the action of spring 93. In this case, the first link 76 is pivoted in the counter clockwise direction by the rotation of the shaft 74 causing the sliding board 79 to move in a parallel fashion toward the note storing section 54 forcing the pushing board 83 through the opening 88 to move banknote B into the storing section 54 and to the holding board 53.

The motion of the links (76, 77, 78) causes the sliding board 79 to rise slightly on the arc during the travel. However, in this case, the pushing board 83 does not slip relative to the banknote B due to friction with the banknote B due to the sliding action of the sliding board 79 against the force of the spring 85. After the banknote B is transported into the storing section 54, the banknote B is first folded around the pushing board but then automatically self-flattens again after passing through the opening 88.

If one or more banknotes are already in the storing section at this point, they are also moved by the pushing board as the driver traces a full circle in a reciprocating motion. Advantageously, a banknote transported through the opening 88 is not damaged since the amount of force applied to the transported banknote is limited by the pulling force of the spring 93.

The driver 35 exerts force on the driving lever 6 to move a banknote B into the storing section during the first half of the reciprocating motion. In the second half of the reciprocating motion, the pushing board is being retracted from the storing section 54 by the force of the spring 95 which keeps the driven pin 32 in contact with the driving section 43 of the driving lever 6 during the second half of the reciprocating motion of the driver 35.

As the driving lever 6 returns by pivoting in a clockwise direction as shown in FIG. 2, the second driven lever 92 is permitted to return to the standby condition by rotating in a clockwise direction as drawn by the springs 86 on both sides of the first link 76. Thus, the moving speed of pushing board 83 depends on the rotation speed of crank 34 because driven section 42 has contact with driver 35.

The holding board 53 stops in the condition that the banknote B is held between the holding board 53 and the right side of the banknote guides (60, 61) so that a banknote B stored in the storing section is held between the banknote guides (60, 61) and the holding board 53. Similarly, the first link rotates in a clockwise direction to return to the standby position with the triangular bracket 80 resting against the plate 87.

The descriptions of various orientations of elements, positions, and movements herein by using words such as up, down, left, and right are for convenience, and are not to be considered as limiting. For example, the embodiment may be utilized in a horizontal or rotated position.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A compact banknote safe, comprising:

a banknote storing section;

a first driven lever mounted in the banknote storing section for receiving a driving force;

a translating unit for non-rotationally displacing a pushing board to move a banknote into the banknote storing section, the pushing board being operated by a second driven lever; and an elastic member attached between the first driven lever and the second driven lever, the elastic member applies a variable contraction force and elastically linking movement of the first driven lever to the second driven lever, wherein the first driven lever can receive a driving force to move in a first direction thereby moving the second driven lever and causing the pushing board to move a banknote into the banknote storing section.

2. The compact banknote safe of claim 1, further comprising:

a banknote access door for removing stored banknotes from the banknote storing section.

3. The compact banknote safe of claim 1, wherein the translating unit includes the pushing board and a parallel linkage assembly.

4. The compact banknote safe of claim 1, wherein the elastic member is a spring.

5. The compact banknote safe of claim 1, wherein the elastic member is a rubber band.

6. The compact banknote safe of claim 3, wherein the parallel linkage assembly further comprises:

a first link member having a first end, and a second end, the first end of the first link member being radially attached to a first shaft, the first shaft is rotated about an axis of the first shaft so that the second end of the first link member moves around the first shaft;

a second link member having a first end, and a second end, the first end of the second link member being radially attached to a second shaft, the second shaft can be rotated an the axis of the second shaft so that the second end of the second link member moves around the second shaft, the axes of the first shaft and the second shaft being parallel to each other, the first shaft and the second shaft being located a predetermined distance apart; and a first bracket member mounted to the pushing board and to the second end of the first link member and the second end of the second link member by pins so that the bracket member will not rotate during displacement as the first shaft is rotated a predetermined amount.

7. The compact banknote safe of claim 6, wherein the translating unit includes a sliding board mounted between the parallel linkage assembly and the pushing board to allow the pushing board to maintain contact with a moving banknote without slipping.

8. The compact banknote safe of claim 6, wherein the parallel linkage assembly further comprises:

a third link member mounted parallel to the second link member, the third link member having a first end, and a second end, the first end of the third link member being radially attached to the second shaft, the second shaft can be rotated about the axis of the second shaft so that the second end of the third link member moves around the second shaft; and a second bracket member mounted parallel to the first bracket member, wherein the first link member is mounted between the first bracket member and the second bracket member while the second link member is mounted on the first bracket member on a side opposite from the first link member and the third link member is mounted on the second bracket member on the side opposite the first link member so that the parallel linkage assembly enables a non-rotational operative movement of the pushing board during contact with a banknote.

9. The compact banknote safe of claim 6, wherein the first bracket member is triangular in shape.

* * * * *